United States Patent [19]

Burnside

[11] 4,282,892

[45] Aug. 11, 1981

[54] PAPER MONEY DISPENSING MEANS

[75] Inventor: Walter M. Burnside, Waukegan, Ill.

[73] Assignee: Bally Manufacturing Corporation, Chicago, Ill.

[21] Appl. No.: 68,615

[22] Filed: Aug. 22, 1979

Related U.S. Application Data

[62] Division of Ser. No. 864,928, Dec. 27, 1977, Pat. No. 4,190,066.

[51] Int. Cl.[3] ..... G07D 1/00

[52] U.S. Cl. ..... 133/1 R; 194/2; 221/153; 221/266; 221/289

[58] Field of Search ..... 221/151, 153, 155, 258, 221/263, 266, 289, 312 R, 312 C; 133/1 R, 2, 4, 5; 194/2

[56] References Cited

U.S. PATENT DOCUMENTS

| | | | |
|---|---|---|---|
| 3,132,654 | 5/1964 | Adams | 133/1 R |
| 3,144,113 | 8/1964 | Peterson | 221/266 X |
| 3,437,238 | 4/1969 | Luba | 221/155 X |
| 4,099,650 | 7/1978 | Immordino | 221/266 |

FOREIGN PATENT DOCUMENTS

| | | | |
|---|---|---|---|
| 1351582 | 11/1964 | France | 221/312 C |

*Primary Examiner*—Joseph J. Rolla

*Attorney, Agent, or Firm*—Callard Livingston

[57] ABSTRACT

A method and apparatus for dispensing paper money or currency bills according to which the bills are lodged in transparent containers fed from a magazine adapted for use in vending, amusement, gaming and other coin-operated or coin-handling machines. The dispensing mechanism is provided with open portions through which the transparent bill containers can be seen through a viewing window in the associated vending-like machine. An electromagnetic dispensing and safety lockout mechanism activates a dispensing gate to release one bill container at a time under control of circuit means in the vending or like associated machine.

2 Claims, 10 Drawing Figures

PAPER MONEY DISPENSING MEANS

This application is a division of parent application Ser. No. 864,928, filed Dec. 27, 1977, now U.S. Pat. No. 4,190,066, and relates to a method and apparatus for dispensing paper money in the familiar form of treasury bills, bank notes and like paper currency and is of particular use in vending and other coin-operated and coin-handling machines which are required to pay out large sums in hard money or coins by means of known types of coin-dispensing apparatus.

Instead of paying out a large number of coins which will deplete the coin supply, machines of the class described can switch automatically from a coin payout operation to paper money dispensing whenever the sum to be paid out requires a number of coins in excess of some predetermined limit.

A system which automatically substitutes paper money for coins in excess of a certain number is described and claimed in the aforesaid parent application, Ser. No. 864,928.

In accordance with the present disclosures a dispensing method is provided in which the bills are contained in individual transparent containers of elongated configuration such that the money contents can be viewed through the container walls, and the containers are stacked in a magazine having open portions exposing the containers to view, the magazine being positioned opposite a viewing window in a coin-actuated or coin handling machine such that the patron of the machine can see the paper currency and understand that the machine is capable of paying out paper money.

In accordance with a further aspect of the disclosures, the dispensing apparatus comprises a simple magazine affording a vertical stacking space for transparent tubular containers having closure means at opposite ends and all or some visible, along with their contents, in the magazine from the lower region of which the containers are ejected one-at-a-time by a rocking cradle actuated by electro-mechanical means when the cradle is released from the holding effect of an electromagnetic safety latch means.

The detailed character of the invention and utilitarian advantages thereof will be more fully evident from the following description of a preferred embodiment thereof taken in view of the annexed drawings in which:

FIG. 1 is a front perspective view of the bill-dispensing unit employed in the system;

FIG. 1-A is a perspective detail of the carrier-ejecting rocker;

FIG. 1-B is a perspective detail of one of the bill-carriers;

Figure 1:
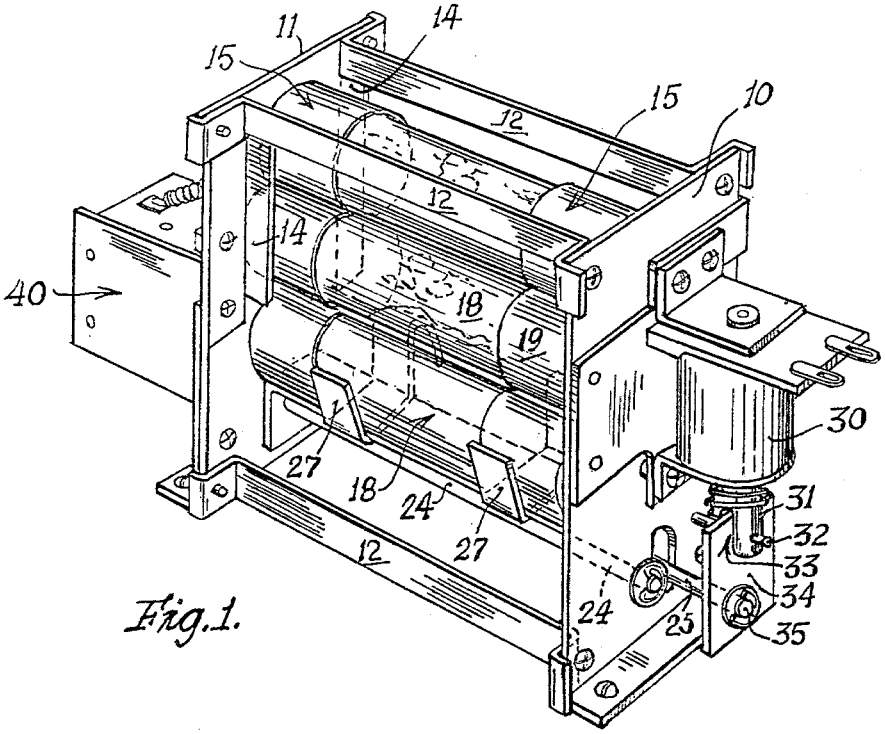

Referring to FIG. 1, the bill dispensing means comprises a magazine formed by opposite end plates 10 and 11 rigidly interconnected by tie bars 12 which are of a width and location preferably leaving large open areas at the sides of the magazine substantially unobstructed so that the bill carriers or cartridges 18 lodged therein can be viewed.

Figure 5:
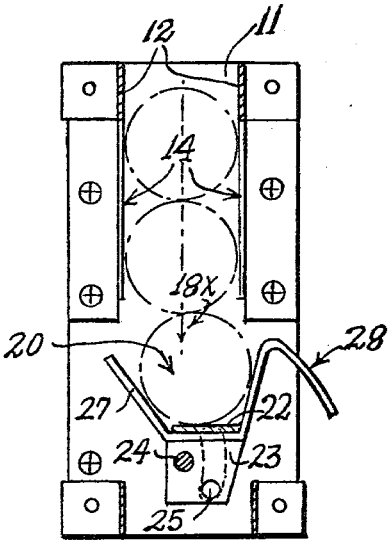
FIGS. 5 and 6 are similar sectional views through the dispensing unit illustrating the normal and ejecting positions of the bill carrier ejecting means in dispensing action.
Figure 6:
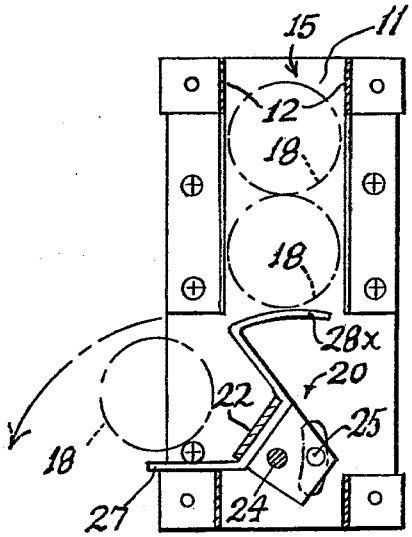

On the inner faces of the end plates are pairs of spaced angle brackets 14 defining vertical cartridge guiding channels 15 in which the opposite ends of cylindrical cartridges 18 are received, as seen in FIGS. 5 and 6 particularly, said ends being fitted with caps 19, FIG. 1-B.

Figure 7:
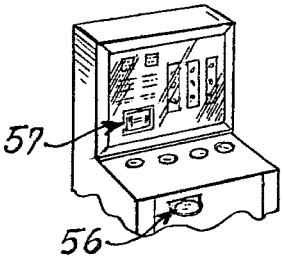
FIG. 7 is a fragmentary view of a form of cabinet in which the dispensing apparatus may be used.

The cartridges 18 may take the preferred form of a cylindrical tube of transparent plastics material having a diameter suitable for rolling of the bills for easy insertion and removal with some identifiable portion, such as the denomination, visible to the observer through the transparent walls thereof, for observation through the open area of the magazine and through a window in the machine cabinet which houses the associated dispensing apparatus, as shown in FIG. 7, as at the window 57.

The loaded bill-containing carriers or cartridges 18 are stacked in the magazine channels 15 in such number as may be necessary for the particular service for which the dispensing apparatus is intended, the magazine being accordingly adapted in capacity to enlargement in the vertical direction to accommodate any number of cartridges by simply adding above the basic unit another set of end plates and tie bars of appropriate dimensions.

Means for ejecting the bill cartridges one at a time from the bottom of the magazine comprises a rockable ejector cradle 20 which may take the form depicted in FIG. 1-A consisting of a simple stamping including a horizontal seating section 22 having opposite downturned end flanges 23 perforated to engage and rock upon a pintle rod 24 seated at opposite ends in the respective end plates 10 and 11 and constituting the entire pivotal support for the cradle. Eccentric control studs 25 and 26 each project respectively from one of the opposite end flanges on the cradle, as in FIGS. 2, 5 and 6, for actuating and lockout purposes, as will appear.

Referring to FIGS. 1-A and 5, the rockable ejecting cradle 20 includes near each end a pair of angularly offset cartridge-retaining projections or finger 27, 28 adapted to flank the opposite sides of the lowermost cartridge lodged on the seating portion 22 so that the cartridge will be captured for purposes of sidewise ejection from the stack when the ejector is rocked from its normal position of FIG. 5 to the discharge position seen in FIG. 6, it being observed in FIG. 5 that the angular disposition of the said flanking fingers projections 27, 28 is such that in the normal position of the ejector, the lowermost cartridge is lodged slightly off-center, as at 18X, relative to a vertical center line through the remaining cartridges above, by reason of the pitch of finger portions 27, while the opposite companion finger portions 28 are pitched at a lesser angle such that the initial push imparted to the lowermost cartridge at the start of the ejecting action will tend to elevate the next higher cartridge slightly and prevent it from dropping until the trailing curved extension 28X thereof can move beneath and support the remaining cartridges while the bottom cartridge is being ejected, all with minimal loading upon the actuating machine, to be described, and minimized potential for jamming.

Figure 2:
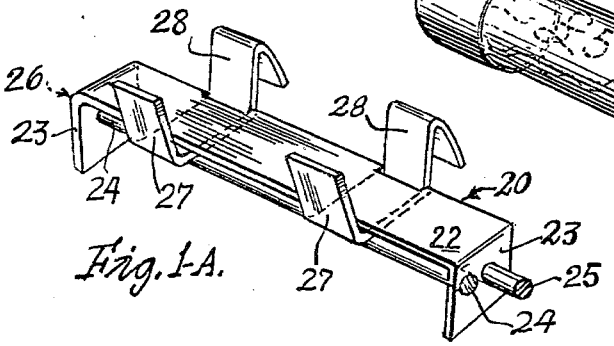
FIG. 2 is a rear elevation of the bill-dispensing unit depicted in FIG. 1 but with the bill carriers removed.
Figure 2:
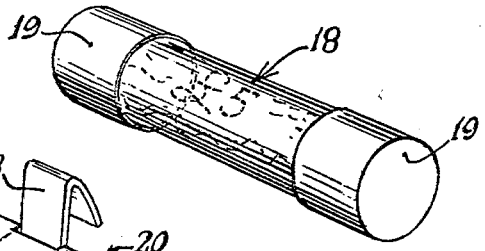
Figure 2:
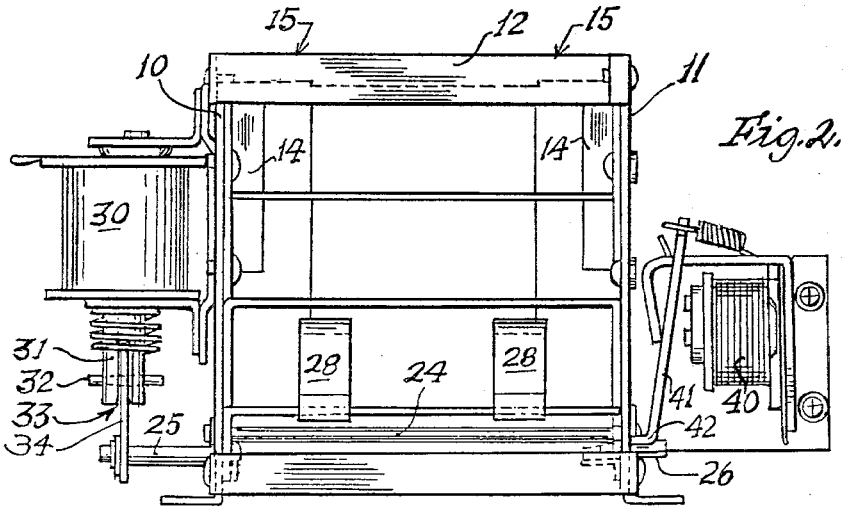
Figure 3:
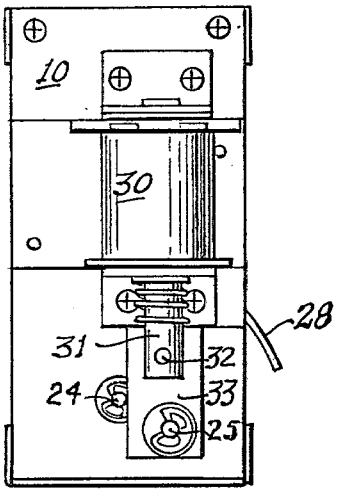
FIG. 3 is an endwise elevation of the dispensing unit showing electromagnetic drive means for actuating the carrier ejector.
Figure 4:
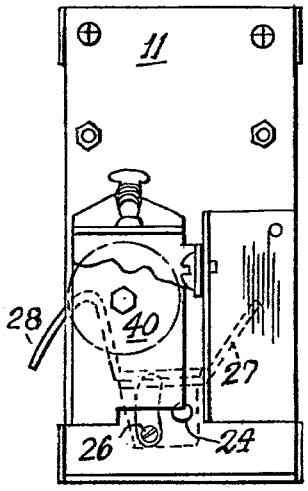
FIG. 4 is an elevational detail of the electromagnetic lockout means disposed on the end of the dispensing unit which is opposite that shown in FIG. 3.

Means for actuating the ejecting cradle may take the form of an electromagnetic solenoid 30 mounted on one of the end plates, as shown in FIGS. 1, 2 and 3, and including a spring-urged plunger 31 coupled to the eccentric cradle pin 25 by a crank plate 34 retained by pin 31 in a slot 33 in the plunger. Responsive to energization of the solenoid 30 by circuit means, to be described, the eccentric crank pin 25 on the cradle will be moved from the normal position seen in FIG. 5 to the operated position shown in FIG. 6 to rock the cartridge dispensing cradle to dispensing position—provided a safety lockout means has first been released, as hereafter explained.

As depicted in FIG. 2, an electromagnetic latching means is provided on the end plate opposite from the dispensing solenoid, and comprises an electromagnet 40 having an armature 41 spring-urged into the normal position seen in FIG. 2 in which an offset latching portion 42 at the end thereof is disposed to overlie and block movement of the eccentric latching stud 26 projecting from the cradle through a slot in the appertaining end plate.

Upon energization of the electromagnet 40 and attraction of its armature 41 the blocking end of the latter is withdrawn and the cradle is free to rock to ejecting position responsive to energization of the actuating solenoid 30, the latching means being effective to guard against fraudulent operation of the bill dispensing unit, as by jarring, probing and the like.

Figure 8:
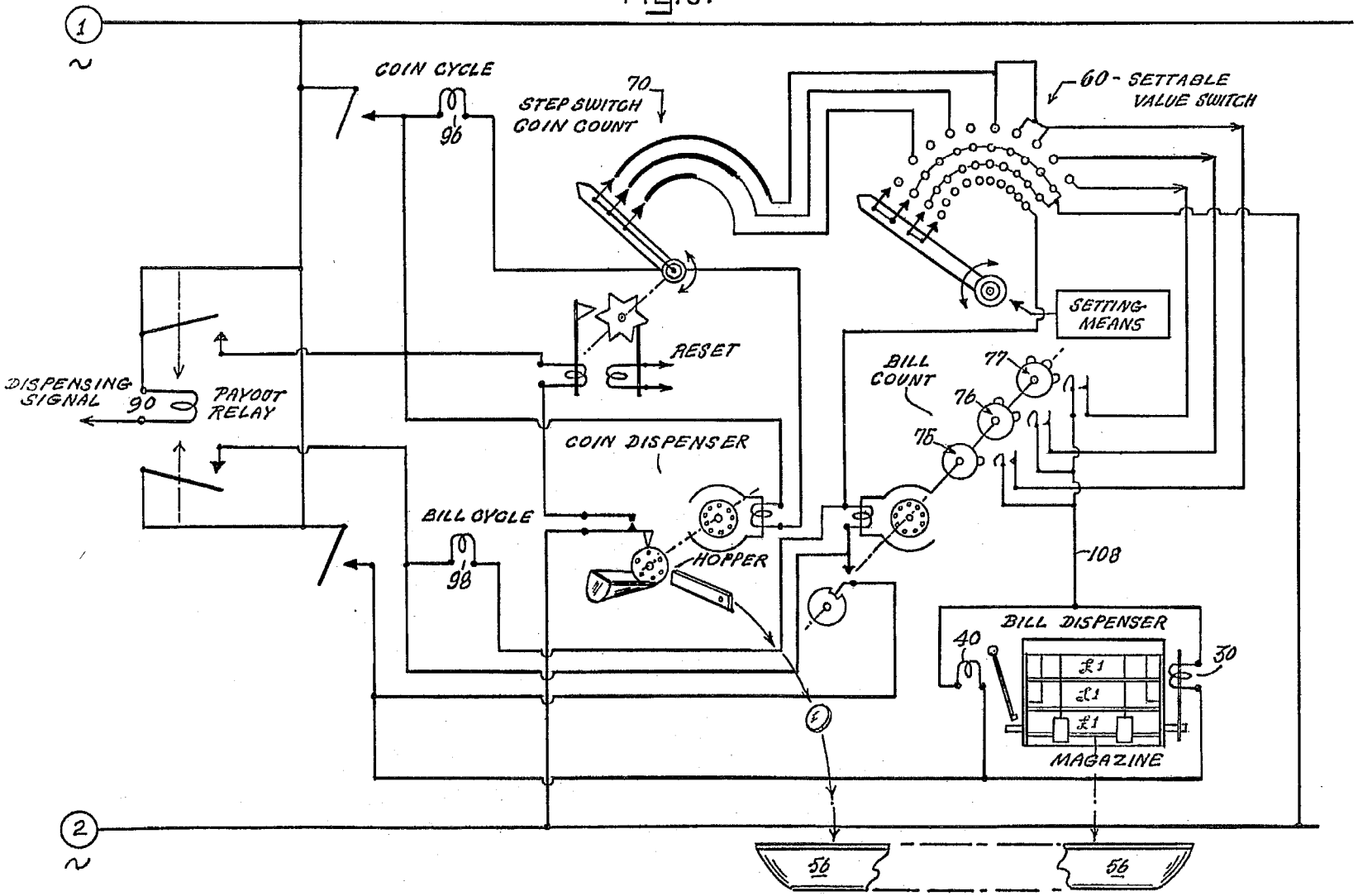
FIG. 8 is a schematic operating and circuit diagram illustrating a preferred form of dispensing system.

The practice of the method and operation of the dispensing device are illustrated in FIG. 8 wherein the dispensing coil 30 and the safety lock-out coil 40 are energized via conductor 108 under control of bill-counting switch means 75, 76, 77 operative respectively to effect dispensation of one, two or three cartridges depending upon the operation of associated step switch coin-counting means 70 and a value switch means 60 when a payout or dispensing signal appear at the payout relay 90 to initiate a payout cycle responsive to operation of a payout cycle relay 96.

The system of FIG. 8 also involves circuitry for automatically shifting any payout from hard money or coins to soft or paper money whenever the number of coins to be paid out exceeds an arbitrary number, such circuitry and features, however, not being further described since they constitute the subject matter of the disclosures and claims of the aforementioned parent application.

The dispensing operation of the bill dispenser, in other respects, when a signal appears on conductor 108, is electrically and mechanically as previously described and in this illustrative embodiment will result in ejection of one, two, or three of the bill containers into the payout receptacle 56 (see also the game machine in FIG. 7), it being understood that any number of such containers may be dispensed within the capacity of the magazine by suitable control circuitry, and such circuitry need not necessarily be the same as in the illustrative arrangement described above in view of FIG. 8.

The following citation constitutes the only prior art presently known to applicant:

U.S. Pat. No. 3,527,238 (Stamp).

While the reference discloses an accounting machine capable of paying out paper money as well as coins, the bills are stacked in storage boxes and transferred by picker arms to conveying cradles at a collating station. No cartridges or transparent containers are employed. The payout for either bills or coins is by means of envelopes into which the sum to be paid is automatically inserted after the assembly operation.

I claim:

1. Mechanism for dispensing transparent tubular paper money cartridges one at a time from a compact viewing magazine adapted for mounting behind a viewing window in a coin-controlled machine, said mechanism comprising: a skeletonized magazine structure having opposite end plates with adjoining opposite side members at least one of the sides being substantially open and said structure being arranged to confine the endwise portions of a single column of said tubular paper money-containing cartridges one upon another, said stack being supported upon a rockable dispensing cradle at the bottom of the magazine, said cradle comprising an inverted U-shaped yoke consisting of a flat bight portion with opposite ends turned down at right angles thereto to provide opposite yoke arms, a rod affixed to the inside of said yoke with opposite pivot ends projecting beyond said arms and each journalled in a corresponding portion of one of said end plates; a lock rod affixed to the inside face of said bight accentrically of said pivot rod and having opposite ends projecting through said yoke arms with ends thereof projecting freely beyond the appertaining end plates; an actuating electromagnet carried at one of the magazine ends and having an armature member drivingly connecting with one of the projecting ends of the lock rod for operation as a crank to rock said cradle from a normal position sustaining the bottom cartridge in the magazine to a dispensing position to discharge such bottom cartridge; a second electromagnet carried at the opposite end of the magazine and having a blocking armature member normally overlying one of the projecting ends of the lock rod to block dispensing movement of the cradle yoke, energization of the second electromagnet moving said armature member to non-blocking position; that one of the sides of the magazine which is substantially open exposing to view a substantial portion of the lengthwise aspects of the contained cartridges for displaying the monetary contents thereof when positioned behind a viewing window in a coin-controlled machine, as aforesaid.

2. Dispensing mechanism according to claim 1 further characterized by the provision of an actuating circuit including an actuating switch operative to connect a source of operating power with said electromagnets to energize the same in coaction to free said cradle for dispensing movement and effect dispensing movement of the freed cradle.

* * * * *